US008884175B2

(12) United States Patent
Botez et al.

(10) Patent No.: US 8,884,175 B2
(45) Date of Patent: Nov. 11, 2014

(54) SELF-LOCKING SWITCH

(75) Inventors: Dan Botez, Bucharest (RO); Alin Bota, Sibiu (RO); Vladimir Karasik, Walled Lake, MI (US)

(73) Assignee: Marquardt GmbH, Rietheim-Weilheim (DE)

( * ) Notice: Subject to any disclaimer, the term of this patent is extended or adjusted under 35 U.S.C. 154(b) by 165 days.

(21) Appl. No.: 13/336,541

(22) Filed: Dec. 23, 2011

(65) Prior Publication Data

US 2013/0161168 A1 Jun. 27, 2013

(51) Int. Cl.
*H01H 13/70* (2006.01)

(52) U.S. Cl.
USPC ..... 200/345; 200/344; 200/341

(58) Field of Classification Search
USPC ..... 200/336, 333, 573
See application file for complete search history.

(56) References Cited

U.S. PATENT DOCUMENTS

| | | | | |
|---|---|---|---|---|
| 5,821,483 | A * | 10/1998 | Yamaguchi et al. | 200/5 R |
| 6,208,271 | B1 * | 3/2001 | Armstrong | 341/34 |
| 6,900,404 | B2 * | 5/2005 | Searle et al. | 200/341 |
| 7,141,743 | B2 * | 11/2006 | Cunningham et al. | 174/520 |
| 7,470,869 | B2 * | 12/2008 | Lin | 200/341 |
| 8,410,385 | B2 * | 4/2013 | Dai | 200/344 |

* cited by examiner

*Primary Examiner* — Renee Luebke
*Assistant Examiner* — Ahmed Saeed
(74) *Attorney, Agent, or Firm* — Burr & Brown, PLLC

(57) ABSTRACT

A self-locking switch including a button sub-assembly and a housing sub-assembly. The button sub-assembly includes at least one button with a tab extending from a lower surface at a first end and at least one shaft engagement point on the lower surface at a second end, and a bracket comprising a first end and a second end with a rotation shaft at the second end. The bracket is rotatably connected to the button. The housing sub-assembly includes a switch housing having engagement points, and a switching mechanism in the housing. The button sub-assembly and the housing sub-assembly are joined together by engaging the tab of the button and the first and second ends of the bracket to corresponding engagement points on the switch housing and the engagement points are not accessible from outside the self-locking switch after the button sub-assembly and the housing sub-assembly are assembled together.

24 Claims, 11 Drawing Sheets

SELF-LOCKING SWITCH

FIELD OF THE INVENTION

The present invention relates to a manually actionable self-locking switch in which the switch components are engaged in an assembled state by latching mechanisms without the use of tools or screws.

BACKGROUND OF THE INVENTION

Existing switches that are used, for example, in electronic equipment, electrical appliances and vehicles, such as automobiles, trucks and vans, on steering wheels, dashboards and center consoles, are typically either straight push type switches or rocking switches. In both cases the switches are assembled using retention hardware, such as screws, to maintain the alignment between switch components and the integrity/security of the switch. However, since the screws used in existing switches are accessible from outside the switch, the screws can be easily removed to open the switch, thereby breaching the security of the switch and potentially disrupting the alignment between switch components.

One option proposed in the art to address this issue was to use one or more metal pins inserted through multiple layers of the switch to join the switch components together. However, insertion of the metal pins through multiple layers of the switch is difficult in mass-production assembly. There is also no way to conceal the metal pins from the outside, which results in the security of the switch being easily breached.

What is needed is a switch that is self-locking that provides security for the switch mechanism and cannot be opened from the outside without breaking one or more components of the switch.

SUMMARY OF THE INVENTION

According to a first aspect of the present invention, there is provided a self-locking switch that includes a button sub-assembly and a housing sub-assembly. The button sub-assembly includes at least one button having an upper surface, a tab extending from a lower surface of the button at a first end thereof, and at least one shaft engagement point on the lower surface of the button at a second end thereof that is opposite to the first end, and a bracket comprising a first end and a second end with a rotation shaft at the second end thereof, the rotation shaft extending substantially perpendicular to the bracket. The bracket is rotatably connected to the button by engaging the rotation shaft of the bracket in the at least one shaft engagement point of the button to form the button sub-assembly. The housing sub-assembly includes a switch housing having engagement points, and a switching mechanism in the housing. The button sub-assembly and the housing sub-assembly are joined together by engaging the tab of the button and the first and second ends of the bracket to corresponding engagement points on the switch housing, such that the engagement points are not accessible from outside the self-locking switch after the button sub-assembly and the housing sub-assembly are assembled together.

In some embodiments of the self-locking switch, the window in the tab extending from the lower surface of the button is larger than an engagement protrusion of the switch housing and defines a movement distance of the button when actuated. In some embodiments, the button further comprises outer edge surfaces extending from sides of the button not adjacent to another button and an inner rib on a side adjacent to another button, where the inner rib engages in a channel in an upper surface of the divider channel when the tab extending from the lower surface of the button engages with an engagement protrusion on the switch housing.

In some embodiments, the bracket further comprises a button divider at the first end thereof and a divider channel connecting the button divider to the rotation shaft. In some embodiments, the switching mechanism comprises a printed circuit board positioned in the housing and an actuator positioned above the printed circuit board.

In some embodiments, the housing sub-assembly further comprising an elastomeric mat having a flat portion and at least one chimney structure, the at least one chimney structure including an electroconductive material in a lower portion of the at least one chimney, where the elastomeric mat is positioned above the printed circuit board and the electroconductive material is positioned above and separated from a trace on an upper surface of the printed circuit board by a predetermined distance. In some of these embodiments, the actuator further comprising two side portions and a cap portion that extends between and connects the two side portions, wherein an upper surface of the at least one chimney structure of the elastomeric mat engages in the cap portion of the actuator when the housing sub-assembly is assembled together. In other embodiments, the electroconductive material in the chimney structure moves downward and into contact with a trace on the printed circuit board when the button is depressed to actuate a circuit. In other embodiments, the elastomeric mat is formed of silicone and the electro-conductive material is carbon.

In some embodiments, at least one engagement point between the button sub-assembly and the housing sub-assembly must be physically broken to open the self-locking switch. In other embodiments, the button divider extends between adjacent buttons and is one of coincident with the upper surface of the buttons and projecting above the upper surface of the buttons when the button sub-assembly and housing sub-assembly are assembled together. In some of these embodiments, the upper surface of the button further comprises one of a raised portion and a depressed portion that is positioned near the first end of the button and substantially above the tab extending from a lower surface of the button.

According to a second aspect of the present invention, there is provided a self-locking switch comprising a button sub-assembly and a housing sub-assembly. The button sub-assembly comprises at least one button having an upper surface, a tab extending from a lower surface of the button at a first end thereof, and at least one shaft engagement point on the lower surface of the button at a second end thereof that is opposite to the first end, and a bracket comprising a first end and a second end with a rotation shaft at a second end thereof, the rotation shaft extending substantially perpendicular to the bracket. The bracket is rotatably connected to the button by engaging the rotation shaft of the bracket in the at least one shaft engagement point of the button to form the button sub-assembly. The housing sub-assembly comprises a switch housing having engagement points, an external electrical connector and a switching mechanism positioned in the housing. The button sub-assembly and the housing sub-assembly are joined together by engaging the tab of the button and the first and second ends of the bracket to corresponding engagement points on the switch housing, such that the engagement points are not accessible from outside the self-locking switch after the button sub-assembly and the housing sub-assembly are assembled together.

In some embodiments, the bracket further comprises a button divider at the first end thereof and a divider channel connecting the button divider to the rotation shaft. In other embodiments, the switching mechanism comprises a printed circuit board positioned in the housing and an actuator positioned above the printed circuit board.

In some embodiments, the window in the tab extending from the lower surface of each button is larger than the engagement protrusion of the switch housing and defines a movement distance for each button when actuated. In other embodiments, each button cover further comprises outer edge surfaces extending from sides of the button not adjacent to another button and an inner rib on a side adjacent to another button, wherein the inner rib engages in a channel in an upper surface of the divider channel when the tab extending from the lower surface of each button engages with an engagement protrusion on the switch housing.

In some embodiments, the housing sub-assembly further comprising an elastomeric mat having a flat portion and at least one chimney structure, the at least one chimney structure including an electroconductive material in a lower portion of the at least one chimney, wherein the elastomeric mat is positioned above the printed circuit board and the electroconductive material is positioned above and separated from a trace on an upper surface of the printed circuit board by a predetermined distance. In some of these embodiments, the actuator further comprises two side portions and a cap portion that extends between and connects the two side portions, wherein an upper surface of the at least one chimney structure of the elastomeric non-conductive mat engages in the cap portion of the actuator when the housing sub-assembly is assembled together. In other embodiments, the electroconductive material in the chimney structure moves downward and into contact with a trace on the printed circuit board when the button is depressed to actuate a circuit. In some embodiments, the elastomeric non-conductive mat is formed of silicone and the electroconductive material is carbon.

In some embodiments, at least one engagement point between the button sub-assembly and the housing sub-assembly must be physically broken to open the self-locking switch. In other embodiments, the button divider extends between the buttons and an upper surface of the button divider portion is one of coincident with the upper surface of the buttons and projecting above the upper surface of the buttons when the button sub-assembly and housing sub-assembly are assembled together. In some of these embodiments, the upper surface of the button further comprises one of a raised portion and a depressed portion that is positioned near the first end of the button and substantially above the tab extending from a lower surface of the button.

BRIEF DESCRIPTION OF THE DRAWINGS

For a fuller understanding of the nature and objects of the invention, reference should be made to the following detailed description of a preferred mode of practicing the invention, read in connection with the accompanying drawings in which.

DETAILED DESCRIPTION OF THE INVENTION

The present invention provides a switch mechanism that is self-locking using a latching mechanism that, after assembly, provides security for the switch mechanism during storage, transportation and installation and cannot be opened from the outside without deforming or breaking one or more components of the switch.

Figure 1:
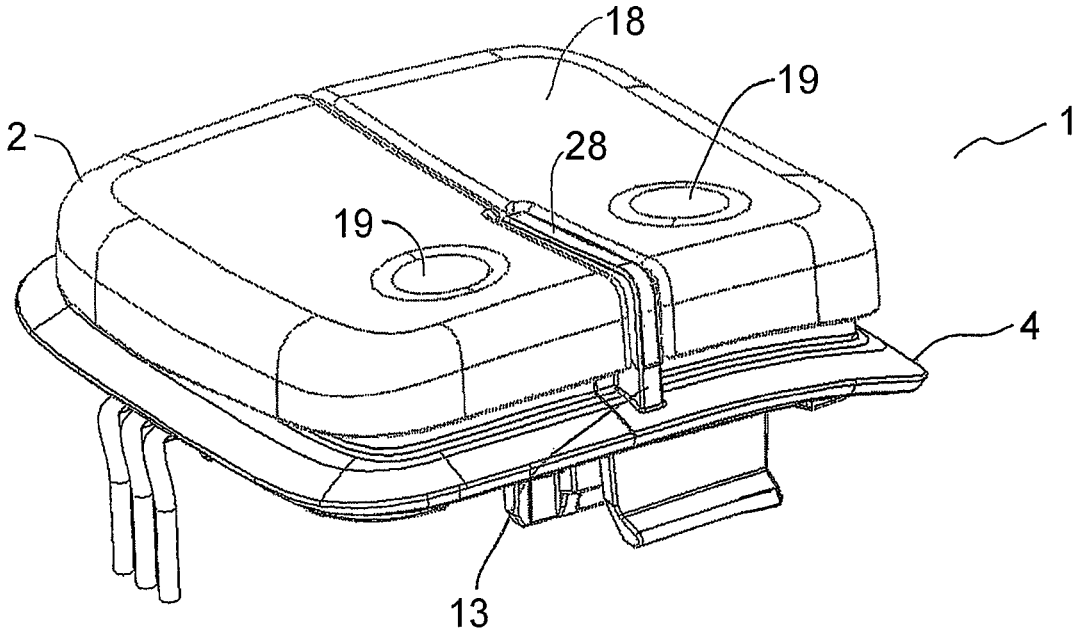
FIG. 1 illustrates one embodiment of the self-locking switch of the present invention.

The component parts of self-locking switch 1 of a first embodiment of the present invention include a first sub-assembly (button sub-assembly) 2 and a second sub-assembly (housing sub-assembly) 4, as shown in FIG. 1.

Figure 2:
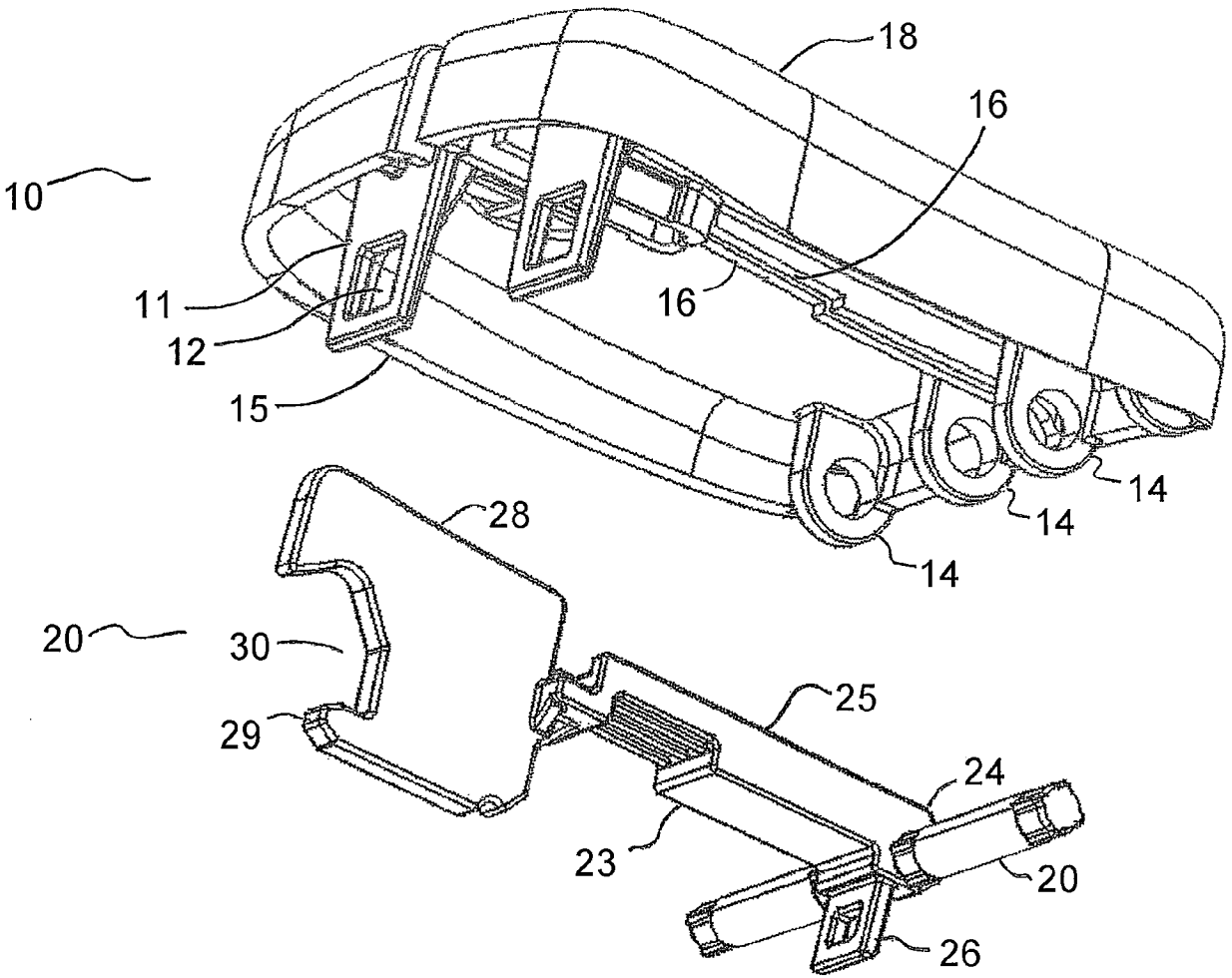
FIG. 2 illustrates the button sub-assembly of the self-locking switch of FIG. 1.
Figure 3:
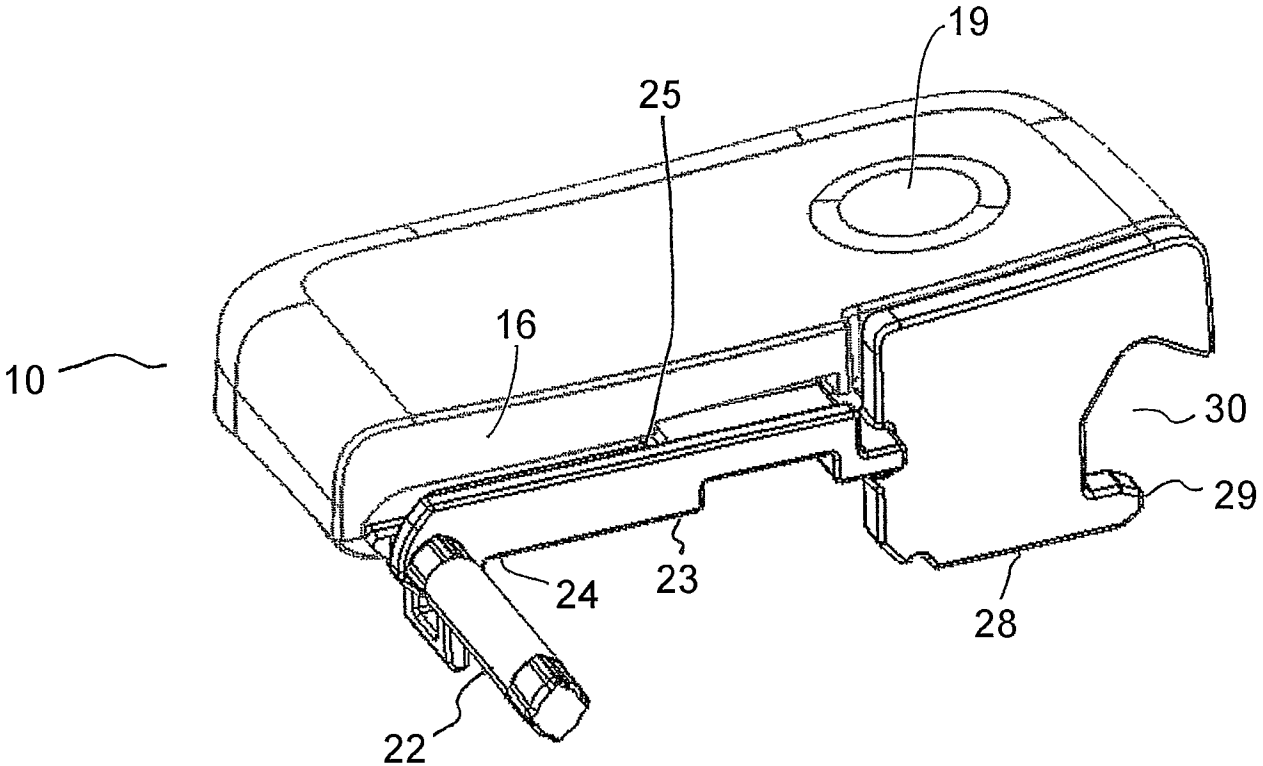
FIG. 3 illustrates a perspective view of the button sub-assembly of FIG. 1 with one button cover in the rest position.

The button sub-assembly in this embodiment includes button 10 and divider shaft 20, as shown in FIG. 2. Each button 10 includes an upper surface 18, outer edges 15 extending from the sides of upper surface 18 of button 10 that are not adjacent to another button, and an inner rib 16 extending from the one or more sides of upper surface 18 of button 10 that are adjacent to another button. In some embodiments, the upper surface 18 includes a tactile locator point 19 on the surface thereof, having one of a raised shape projecting above the surface of the upper surface 18 of button 10 or a depressed shape formed as a depression in the surface of the upper surface 18 of button 10, as shown in FIG. 3. Button 10 can be formed of one or a thermoplastic, a metal and a resin composite. The upper surface is one of a smooth surface and a textured surface.

Each button 10 includes one or more shaft rotational engagement points 14 on an underside of the button at one end of button 10 and a tab 11 extending approximately perpendicular from the underside of button 10 near the end opposite to the one or more shaft rotational engagement points 14. Tab 11 includes window 12, which is sized to be larger than a protrusion that engages into window 12 when the button sub-assembly 2 and the housing sub-assembly 4 are joined together, as will be explained in more detail below.

Figure 4:
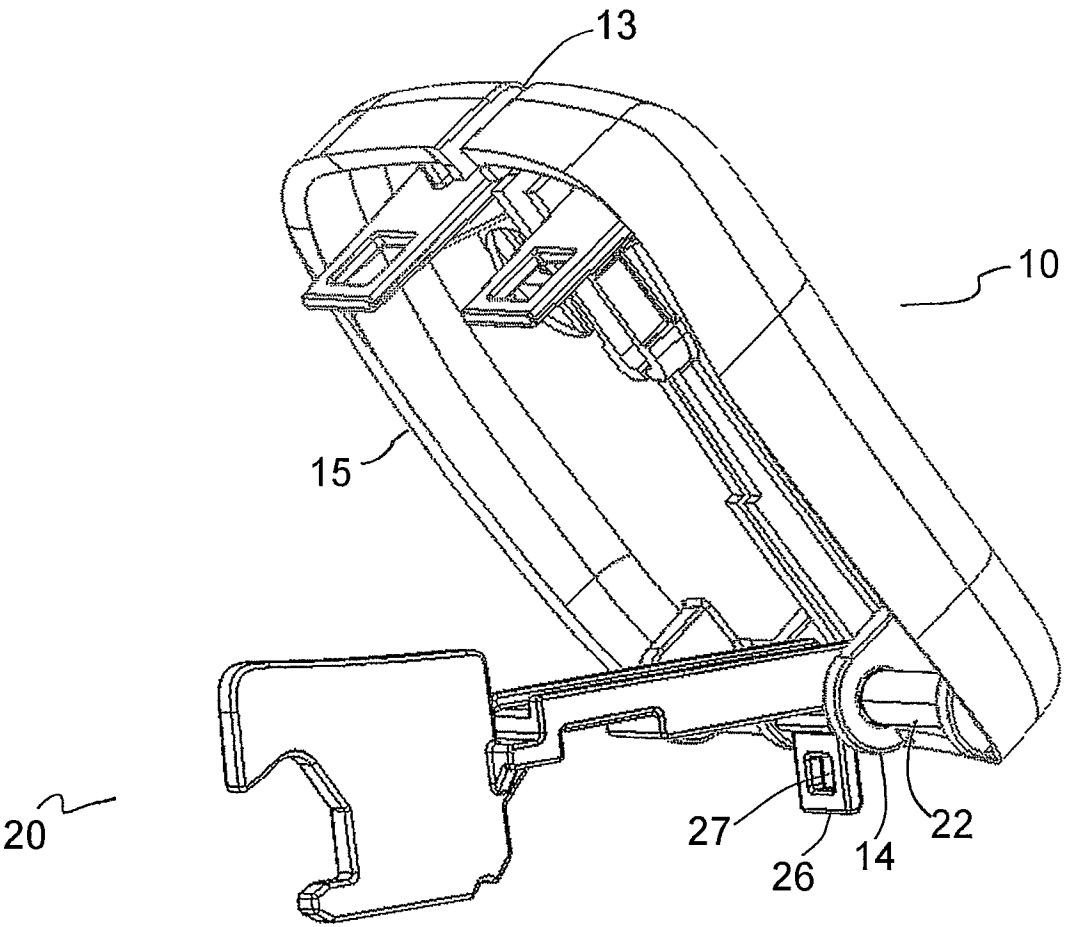
FIG. 4 illustrates the connection between components of the button sub-assembly of FIG. 1.

In one embodiment, the one or more shaft rotational engagement points 14 are at the end that is opposite tactile locator point 19 and the tab 11 extending approximately perpendicular from the underside of button 10 is located near the opposing end at a position between tactile locator point 19 and outer edge 15 of button 10, as shown in FIG. 4.

Divider 20 includes a rotation shaft 22 that connects to divider channel 23 via shaft connection portion 24 and extends approximately perpendicular from one end of divider channel 23, as shown in FIG. 2. Shaft connection portion 24 includes tab portion 26 that extends from the underside of shaft connection portion 24 below rotation shaft 22 and includes window 27 which engages with a protrusion when the button sub-assembly 2 and the housing sub-assembly 4 are joined together, as will be explained in more detail below. In a single button embodiment, divider 20 is replaced by a bracket that has a rotation shaft at one end thereof.

In some embodiments, an upper surface of divider channel 23 includes two side walls extending above the upper surface forming divider channel body portion 25 that extend from shaft connection portion 24 to button divider 28, as shown in FIG. 3. Button divider 28 is a flat elongated portion of divider shaft 20 that attaches to and extends from the end of divider channel 23 opposite shaft 22. Button divider 28 extends vertically above and below divider channel 23 and includes notched area 30 at an end opposite divider channel 23 having an engagement protrusion 29 extending below notched area 30 of button divider 28. The engagement protrusion 29 can be one of a hook and a shaped protrusion that engages in a window on a tab, as will be explained in more detail below. Divider 20 can be formed of one or a thermoplastic, a metal and a resin composite.

In some embodiments, the inner rib 16 of button 10 includes an indented portion 13 (see FIG. 1) that extends along and enables button divider 28 to project either coincident with or above the upper surface 18 of button 10, as shown in FIG. 3. The upper portion of button divider 28 provides a physical separation between adjacent button covers that an operator can locate easily by tactile feel.

Figure 5:
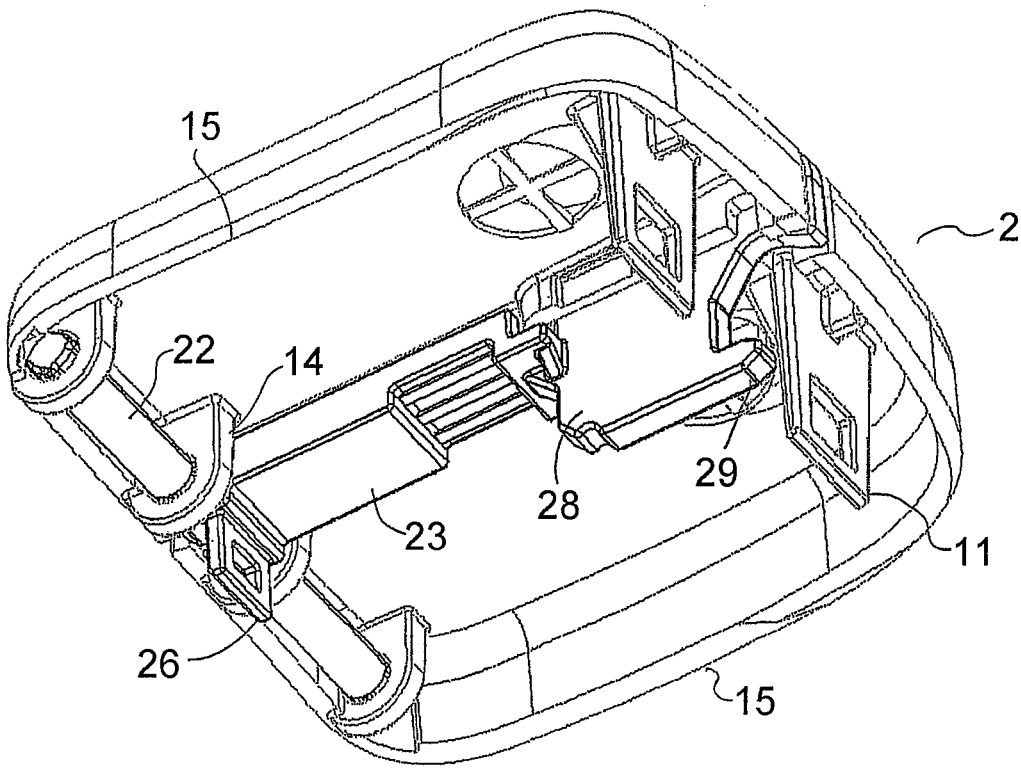
FIG. 5 illustrates the button sub-assembly of FIG. 1 viewed from below.

The button sub-assembly 2 is formed by joining one or more buttons 10 and one or more dividers 20 by sliding rotation shaft 22 into shaft rotational engagement points 14 on the underside of button 10 with buttons at an angle to divider 20, as shown in FIG. 4. Inner rib 16 of button 10 extends a shorter distance substantially perpendicular to upper surface 18 then outer edges 15 to (i) enable inner rib 16 to engage in channel body portion 25 to provide lateral stability for button 10 and (ii) enable outer edges 15 to shield outer portions of rotation shaft 22 from outside of self-locking switch 1 when button sub-assembly 2 and housing sub-assembly 4 are joined together. A complete button sub-assembly 2 of one embodiment when viewed from below is shown in FIG. 5.

Figure 6A:
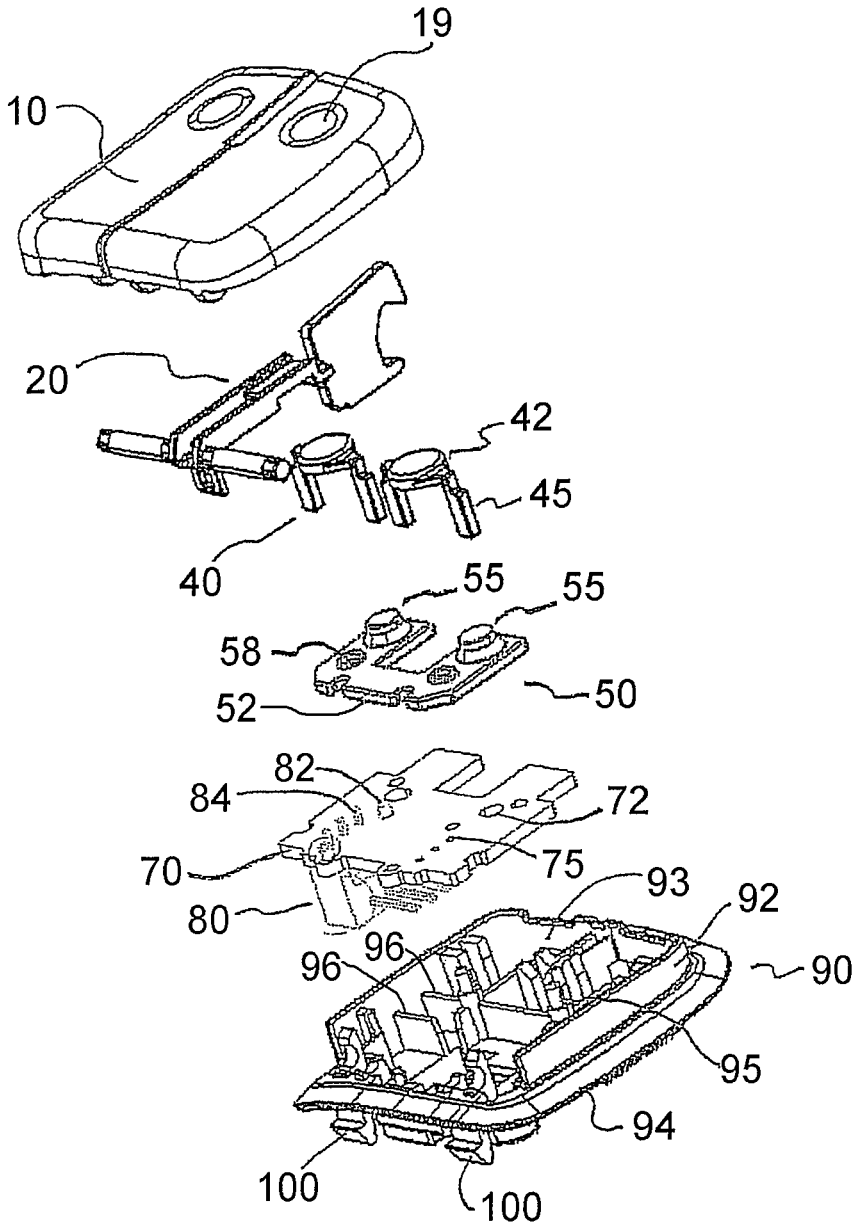
FIGS. 6*a* and 6*b* illustrate upper and lower perspective exploded views of the self-locking switch of FIG. 1.
Figure 6B:
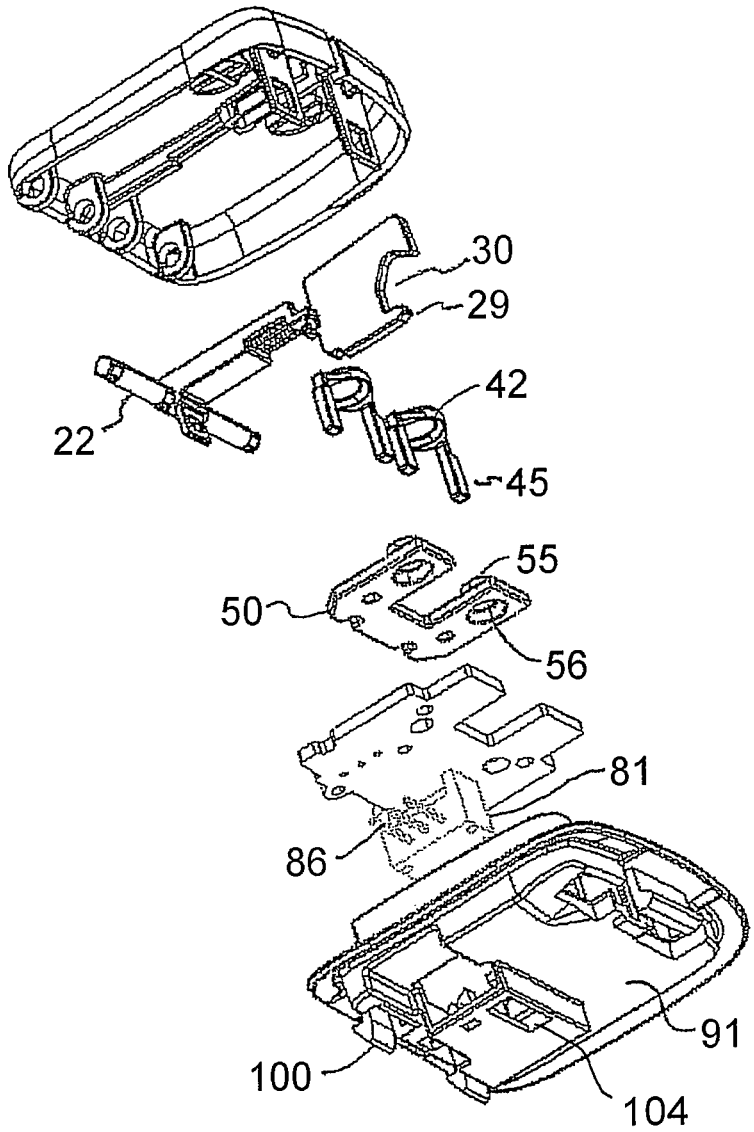

The second sub-assembly (or housing sub-assembly) of the one embodiment of the present invention includes actuators 40, elastomeric mat 50, printed circuit board 70, and action pin header 80, all of which are physically positioned inside of lower switch housing 90, as shown in FIGS. 6*a* and 6*b*.

Actuator 40 includes cap portion 42 and side portions 45, as shown in FIGS. 6*a* and 6*b*. The cap portion 42 has a circular-shaped center portion having a lower edge extending from the circular-shaped center portion to form an enclosed area beneath the circular-shaped center portion that is sized to interface with and enclose the upper portion of one of chimney structures 55 on elastomeric mat 50 when positioned inside of lower switch housing 90. The cap portion also includes straight portions that extend from at least opposing sides of the circular-shaped center portion and connect with side portions 45. Side portions 45 extend substantially perpendicular from cap portion 42 in the same direction as the lower edge extending from the circular-shaped center portion. Actuator 40 can be formed of one or a thermoplastic, a metal and a resin composite.

Elastomeric mat 50 includes a flat portion 52 having one or more locator pin alignment holes 58 extending through flat portion 52 and one or more chimney structures 55 projecting above flat portion 52 of elastomeric mat 50, as shown in FIGS. 6*a* and 6*b*. Flat portion 52 and an upper portion of chimney structures 55 are formed of a non-conductive elastomeric material such as silicone rubber, nitrile rubber, ethylene-propylene rubber, fluorocarbon rubber, chloroprene rubber, fluorosilicone rubber, polyacrylate rubber, ethylene acrylic rubber, styrene-butadiene rubber, natural rubber, and polymers thereof, or a polyester urethane compound having sufficient resiliency to return to its initial shape when no pressure is being applied to the chimney structure.

Chimney structures 55 have an upper surface of the non-conductive elastomeric material and an electro-conductive material 56 formed in an upper portion of the raised portion of chimney structure 55, as shown in FIG. 6*b*. The electro-conductive material 56 in chimney structure 55 is positioned so that electro-conductive material 56 is physically above a lower surface of flat portion 52 of elastomeric mat 50. The electro-conductive material 56 can be formed of one of a metal and a carbon material.

Printed circuit board (PCB) 70 is a double sided or multi-layered PCB that includes pin connections 75 and at least one metal trace 77 (not shown). In some embodiments, PCB 70 also includes alignment holes 72.

Figure 10:
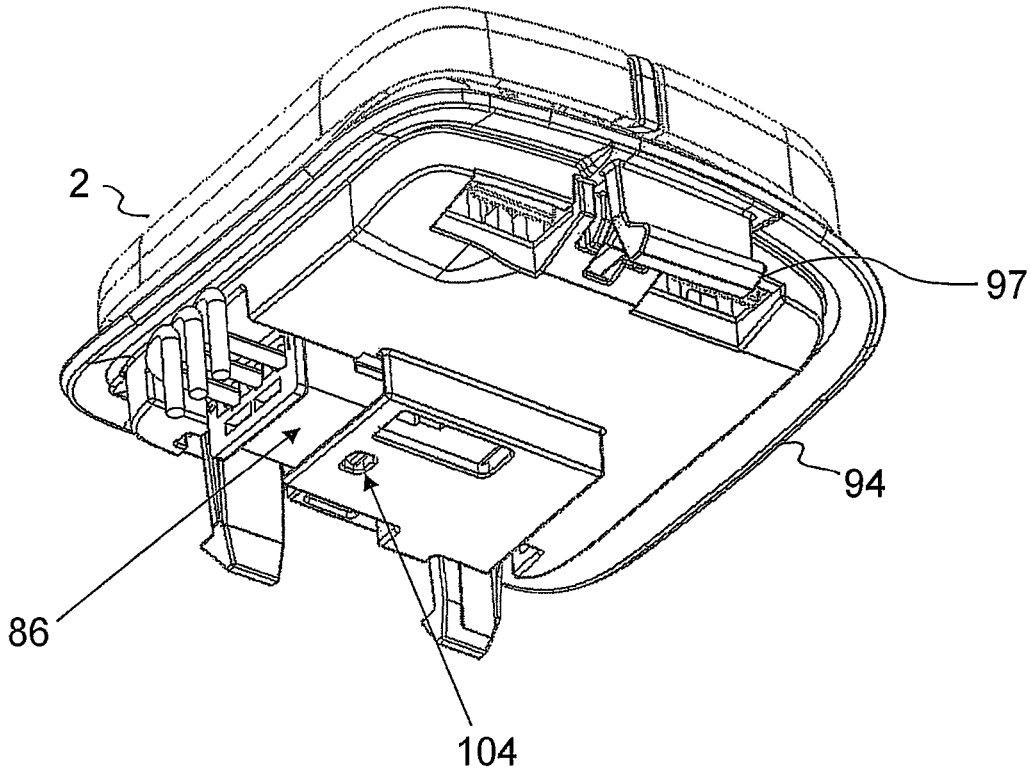
FIG. 10 illustrates an external connections arrangement in one embodiment of the self-locking switch of FIG. 1.

Action pin header 80 includes action pin body 81, which contains the action pin circuitry, and alignment pins 82 and interface pins 84 that are positioned at one end of action pin body 81, as shown in FIGS. 6*a* and 6*b*. Interface pins 84 provide electrical connections between action pin header 80 and PCB 70. Action pin body 81 also includes external connections 86 at an end opposite to alignment pins 82 and interface pins 84. In one embodiment, the external connections 86 is a single external connector, as shown in FIG. 10. In this embodiment, the lower switch housing includes a connector latching window 104 on a lower surface thereof.

Figure 7A:
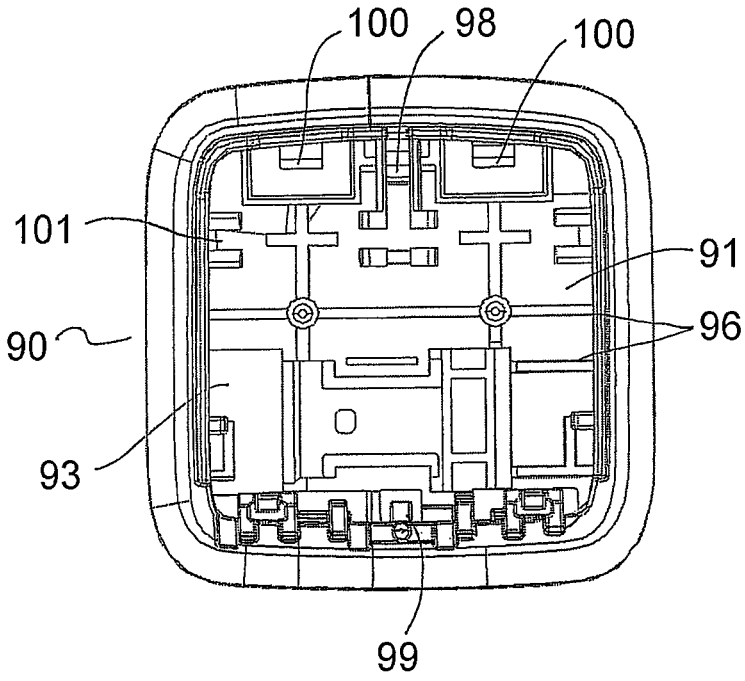
FIGS. 7*a*-7*c* illustrate views of the lower housing of the self-locking switch of FIG. 1.
Figure 7B:
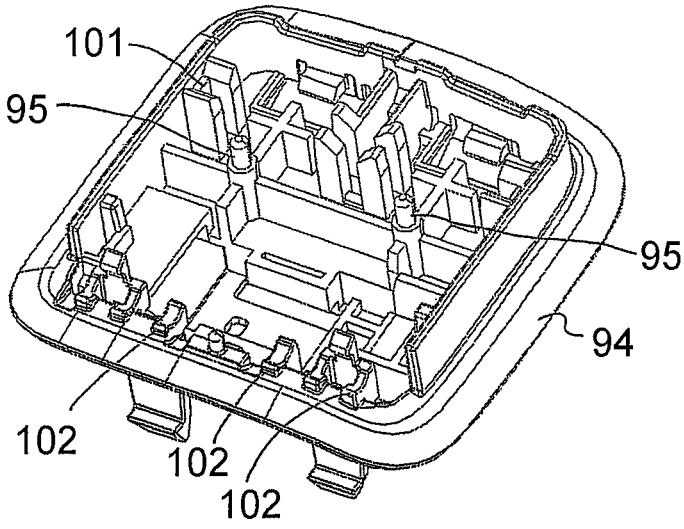
Figure 7C:
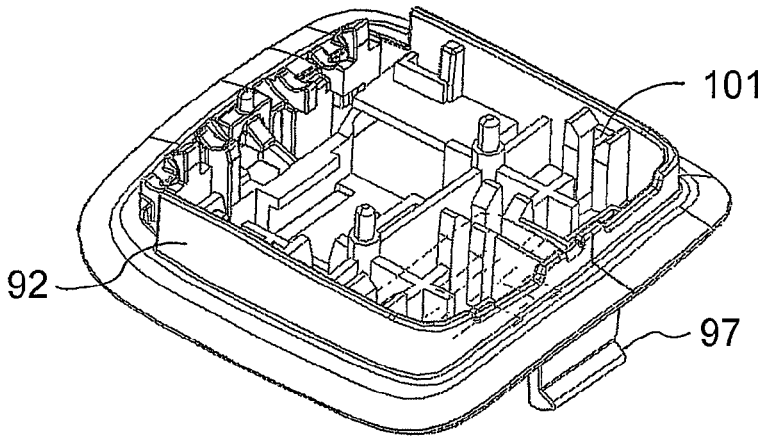

Lower switch housing 90 can be formed of one of a thermoplastic, a metal and a resin composite, and includes a lower surface 91, side walls 92 extending substantially perpendicular above lower surface 91 and defining inner area 93, and an outer housing surface 94 that extends from an outer surface of side walls 92 in a direction parallel to lower surface 91 and substantially perpendicular to side walls 92, as shown in FIGS. 7*a-c*. Inner area 93 includes locator pins 95, a plurality of alignment channels or walls 96 that are formed on the upper surface of lower surface 91 of lower switch housing 90, slots 101, and engagement protrusion 99 that engages in window 27 in tab portion 26 that extends from the underside of shaft connection portion 24 when the first sub-assembly and the second sub-assembly are snapped together. Protruding portion 97 extends from the underside of one end of lower switch housing 90 and includes window 98 that engages with engagement protrusion 29 on button divider 28 of divider 20. Pivot catches 102 are positioned along one edge of inner area 93, as shown in FIG. 7*c*. Pivot catches 102 engage and retain shaft 22 of divider 20 to provide a pivot axis for button 10 when button sub-assembly 2 and housing sub-assembly 4 are joined together to form self-locking switch 1.

Figure 8:
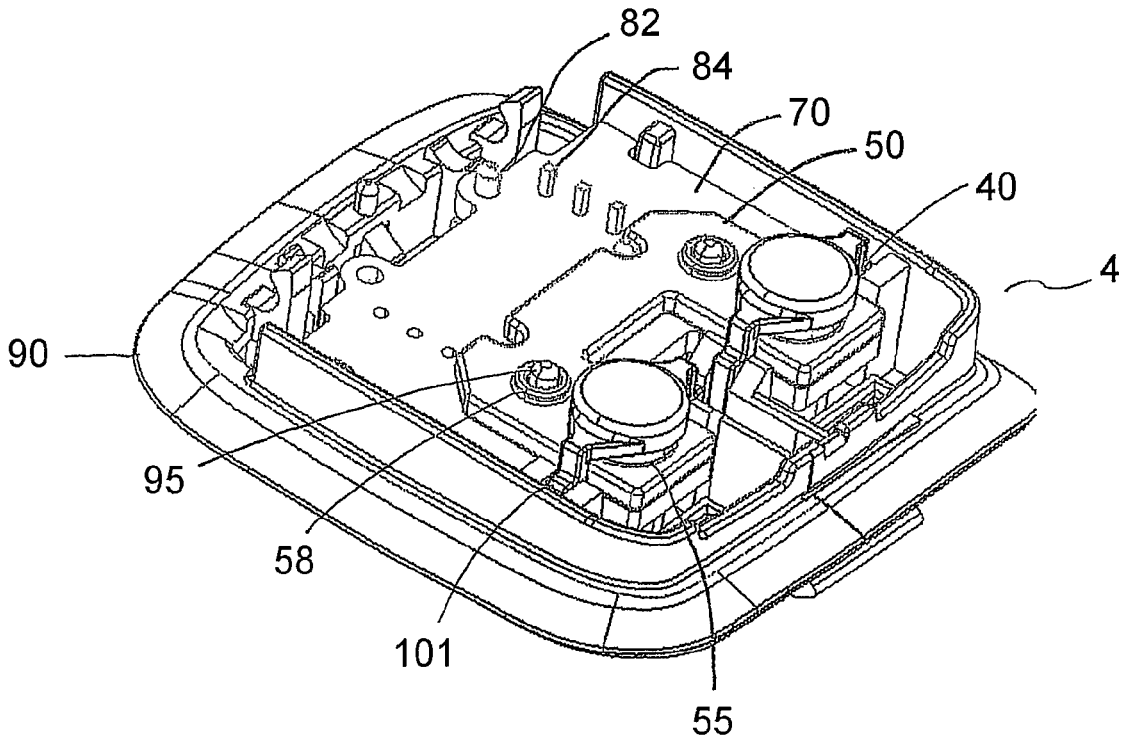
FIG. 8 illustrates the housing sub-assembly of the self-locking switch of FIG. 1.

The housing sub-assembly 4 is formed by positioning action pin header 80 in alignment channels 96 that restrain the movement of action pin header in lower switch housing 90, as shown in FIG. 8. External connections 86 of action pin header 80 extends through openings in a lower housing 90 to connect to an interface external to self-locking switch 10. PCB 70 is positioned on an upper surface of action pin body 81 to interface with alignment pins 82 and interface pins 84 extend through the pin connections 75 on PCB 70. In some embodiments, locator pins 95 of lower switch housing 90 extend through alignment holes 72 on PCB 70.

Elastomeric mat 50 is then positioned on an upper surface of PCB 70 so that locator pins 95 of lower switch housing 90 extend through locator pin alignment holes 58, as shown in FIG. 8. When the elastomeric mat 50 is positioned on PCB 70, electro-conductive material 56 is positioned directly above but spaced from one of metal trace 77. Each actuator 40 is then positioned so that each cap portion 42 is in direct contact with an upper surface of chimney structure 55 and each side portion 45 is positioned within a slot 101 on lower switch housing 90 that permits the actuator 40 to move up and down on the chimney structure, as shown in FIG. 8.

Figure 9:
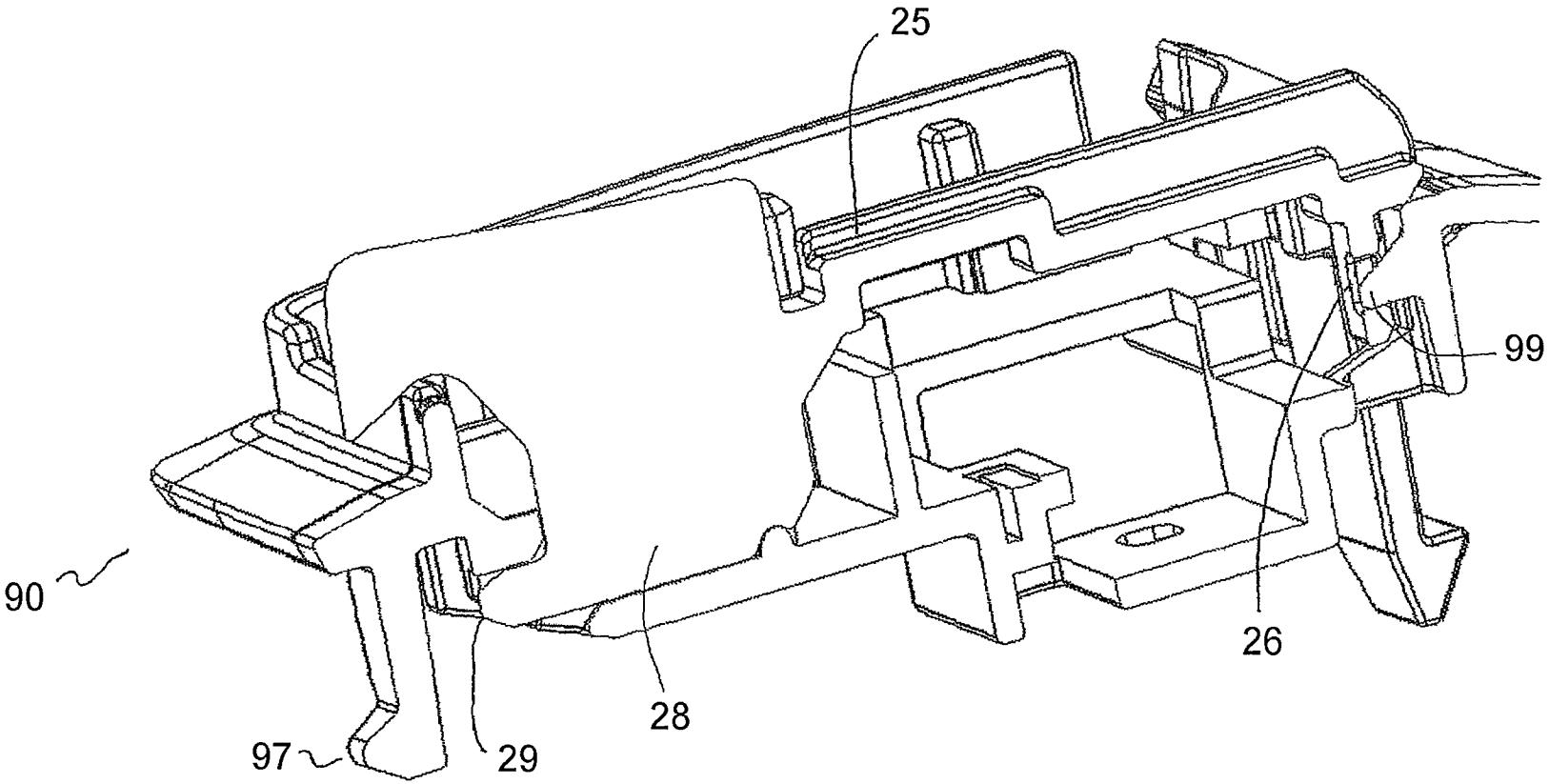
FIG. 9 illustrates the engagement between the button sub-assembly and the housing sub-assembly of the self-locking switch of FIG. 1.

The button sub-assembly and the housing sub-assembly are joined together by a multiple latching mechanisms that snap together to provide security for the switch mechanism. In one embodiment, the engagement sequence starts with the engagement of engagement protrusion 29 of flat divider portion 28 into window 98 on protruding portion 97 that extends below the underside of lower switch housing 90, as shown in FIG. 9. Then pressure is applied to the opposing end of button 10, which is engaged with rotation shaft 22, to lower tab portion 26 that extends from the underside of shaft connection portion 24 until engagement protrusion 99 on lower switch housing 90 latches into window 27 in tab portion 26 and rotation shaft 22 engages in pivot catches 102. Then buttons 10 are rotated on rotation shaft 22 and pressure is applied until each engagement protrusion 100 on lower switch housing 90 engages in the associated window 12 in tab 11 that extends from the underside of each button 10, as shown in FIG. 7.

When engagement protrusion 99 is positioned within window 27, the opposing end of button divider 28 is positioned in close proximity to one of alignment channels 96 such that engagement protrusion 99 cannot be disengaged from window 26 without damaging one or more of the multiple latching mechanism joining the button sub-assembly 2 and the housing sub-assembly 4. Similarly, button divider 28, engagement protrusion 99 and window 27 prevent the disengagement of protrusion 29 of button divider 28 from window 98 without damaging one or more of the multiple latching mechanisms joining the button sub-assembly and the housing sub-assembly.

Divider 20 of the present invention provides several key features of the present invention including (i) rotation connection at one end of button 10, (ii) a tab with window at a first end and an engagement protrusion at a second opposing end of divider 20 for latching engagement of button sub-assembly 2 and the housing sub-assembly 4, (iii) a physical divider that extends between and separates adjacent buttons 10, (iv) a back portion of button divider 28 for preventing disengagement of one or more of the multiple latching mechanisms that snap together, and (v) providing retention and stability for PCB 70, elastomeric mat 50 and actuators 40 when the button sub-assembly 2 and the housing sub-assembly 4 are joined together.

When the button sub-assembly 2 and the housing sub-assembly 4 are joined together, divider 20 physically separates inner area 93 of lower switch housing 90 into separate portions for each button. Divider channel 23 engages with inner rib 16 of each button 10 and together with rotation shaft 22/shaft rotational engagement points 14 and engagement protrusion 100/window 12 in tab 11 provide lateral stability for each button 10. Divider 20 physically provides rigidity to each button of the switch assembly, physically separates adjacent switches, and minimizes transverse movement to prevent adjacent switches from displacing laterally and coming into contact with each other. Divider 20 also provides water intrusion protection for self-locking switch 1.

After the self-locking switch 1 is fully assembled, rotation shaft 22 provides a rotation axis for operation of each button. The movement distance of each button is defined by the height difference between the size of window 12 in tab 11 and engagement protrusion 100. When button 10 is depressed by an operator, button 10 depresses cap portion 42 of actuator 40, which applies pressure to the associated chimney structure 55 causing electro-conductive material 56 to contact trace 77 on PCB 70 to complete a circuit that is associated with the depressed button. When the operator releases pressure on button 10, the non-conductive elastomeric material forming chimney structure 55 returns to its original shape, which breaks the contact between electro-conductive material 56 and trace 77 and returns electro-conductive material 56 to a position above but separated from trace 77.

While the present invention has been particularly shown and described with reference to the preferred mode as illustrated in the drawings, it will be understood by one skilled in the art that various changes in detail may be effected therein without departing from the spirit and scope of the invention as defined by the claims.

NUMERICAL DESIGNATIONS

1—self-locking switch;
2—first sub-assembly;
4—second sub-assembly;
10—button;
11—tab (extending from underside of button);
12—window in tab;
13—indented portion;
14—shaft rotational engagement points;
15—outer edges;
16—inner rib;
18—upper surface;
19—tactile locator point (raised/depressed);
20—divider;
22—rotation shaft;
23—divider channel;
24—shaft connection portion;
25—divider channel body portion;
26—tab portion extending from underside of shaft connection portion;
27—window in tab portion 26;
28—button divider;
29—engagement protrusion (of flat divider portion);
30—notched area (of flat divider portion)
40—actuator;
42—cap portion;
45—side portions;
50—elastomeric mat;
52—flat portion;
55—chimney structure;
56—electro-conductive material (in chimney structure);
58—locator pin alignment holes;
70—PCB;
72—alignment holes;
75—pin connections;
77—metal trace;
80—action pin header
81—action pin body;
82—alignment pins;
84—interface pins;
86—external connections;
90—lower switch housing;
91—lower surface;
92—side walls;
93—inner area;
94—outer housing surface;
95—locator pins;
96—alignment channels;
97—protruding portion (extending below underside of lower switch housing);
98—window for engagement protrusion on flat divider portion;
99—engagement protrusion (for window in tab extending from underside of shaft connection portion);
100—engagement protrusion (for window in tab extending from underside of button covers);

101—slot for actuator side portion;
102—pivot catch;
104—connector latching window.

We claim:

1. A self-locking switch comprising:

a button sub-assembly comprising at least one button having an upper surface, a tab extending from a lower surface of the button at a first end thereof, and at least one shaft engagement point on the lower surface of the button at a second end thereof that is opposite to the first end, and a bracket comprising a first end and a second end with a rotation shaft at the second end thereof, the rotation shaft extending substantially perpendicular to the bracket, wherein the bracket is rotatably connected to the button by engaging the rotation shaft of the bracket in the at least one shaft engagement point of the button to form the button sub-assembly; and a housing sub-assembly comprising a switch housing having engagement points, and a switching mechanism in the switch housing, wherein the button sub-assembly and the housing sub-assembly are joined together by engaging the tab of the button and the first and second ends of the bracket to corresponding engagement points on the switch housing, such that the engagement points are not accessible from outside the self-locking switch after the button sub-assembly and the housing sub-assembly are assembled together.

2. The self-locking switch of claim 1, wherein a window in the tab extending from the lower surface of the button is larger than an engagement protrusion of the switch housing and defines a movement distance of the button when actuated.

3. The self-locking switch of claim 1, the bracket further comprising a button divider at the first end thereof and a divider channel connecting the button divider to the rotation shaft.

4. The self-locking switch of claim 1, wherein the switching mechanism comprises a printed circuit board positioned in the housing and an actuator positioned above the printed circuit board.

5. The self-locking switch of claim 3, the button further comprising outer edge surfaces extending from sides of the button not adjacent to another button and an inner rib on a side adjacent to another button, wherein the inner rib engages in a channel in an upper surface of the divider channel when the tab extending from the lower surface of the button engages with an engagement protrusion on the switch housing.

6. The self-locking switch of claim 4, the housing sub-assembly further comprising an elastomeric mat having a flat portion and at least one chimney structure, the at least one chimney structure including an electroconductive material in a lower portion of the at least one chimney, wherein the elastomeric mat is positioned above the printed circuit board and the electroconductive material is positioned above and separated from a trace on an upper surface of the printed circuit board by a predetermined distance.

7. The self-locking switch of claim 6, the actuator further comprising two side portions and a cap portion that extends between and connects the two side portions, wherein an upper surface of the at least one chimney structure of the elastomeric mat engages in the cap portion of the actuator when the housing sub-assembly is assembled together.

8. The self-locking switch of claim 7, wherein the electroconductive material in the chimney structure moves downward and into contact with a trace on the printed circuit board when the button is depressed to actuate a circuit.

9. The self-locking switch of claim 8, wherein the elastomeric mat is formed of silicone and the electro-conductive material is carbon.

10. The self-locking switch of claim 1, wherein at least one engagement point between the button sub-assembly and the housing sub-assembly must be physically broken to open the self-locking switch.

11. The self-locking switch of claim 3, wherein the button divider extends between adjacent buttons and is one of coincident with the upper surface of the buttons and projecting above the upper surface of the buttons when the button sub-assembly and housing sub-assembly are assembled together.

12. The self-locking switch of claim 11, wherein the upper surface of the button further comprises one of a raised portion and a depressed portion that is positioned near the first end of the button and substantially above the tab extending from a lower surface of the button.

13. A self-locking switch comprising:

a button sub-assembly comprising at least one button having an upper surface, a tab extending from a lower surface of the button at a first end thereof, and at least one shaft engagement point on the lower surface of the button at a second end thereof that is opposite to the first end, and a bracket comprising a first end and a second end with a rotation shaft at a second end thereof, the rotation shaft extending substantially perpendicular to the bracket, wherein the bracket is rotatably connected to the button by engaging the rotation shaft of the bracket in the at least one shaft engagement point of the button to form the button sub-assembly; and a housing sub-assembly comprising a switch housing having engagement points, an external electrical connector and a switching mechanism positioned in the switch housing, wherein the button sub-assembly and the housing sub-assembly are joined together by engaging the tab of the button and the first and second ends of the bracket to corresponding engagement points on the switch housing, such that the engagement points are not accessible from outside the self-locking switch after the button sub-assembly and the housing sub-assembly are assembled together.

14. The self-locking switch of claim 13, the bracket further comprising a button divider at the first end thereof and a divider channel connecting the button divider to the rotation shaft.

15. The self-locking switch of claim 13, wherein the switching mechanism comprises a printed circuit board positioned in the housing and an actuator positioned above the printed circuit board.

16. The self-locking switch of claim 13, wherein a window in the tab extending from the lower surface of each button is larger than the engagement protrusion of the switch housing and defines a movement distance for each button when actuated.

17. The self-locking switch of claim 14, each button cover further comprising outer edge surfaces extending from sides of the button not adjacent to another button and an inner rib on a side adjacent to another button, wherein the inner rib engages in a channel in an upper surface of the divider channel when the tab extending from the lower surface of each button engages with an engagement protrusion on the switch housing.

18. The self-locking switch of claim 15, the housing sub-assembly further comprising an elastomeric mat having a flat portion and at least one chimney structure, the at least one chimney structure including an electroconductive material in a lower portion of the at least one chimney, wherein the elastomeric mat is positioned above the printed circuit board and the electroconductive material is positioned above and separated from a trace on an upper surface of the printed circuit board by a predetermined distance.

19. The self-locking switch of claim 15, the actuator further comprising two side portions and a cap portion that extends between and connects the two side portions, wherein an upper surface of the at least one chimney structure of the elastomeric non-conductive mat engages in the cap portion of the actuator when the housing sub-assembly is assembled together.

20. The self-locking switch of claim 19, wherein the electroconductive material in the chimney structure moves downward and into contact with a trace on the printed circuit board when the button is depressed to actuate a circuit.

21. The self-locking switch of claim 20, wherein the elastomeric non-conductive mat is formed of silicone and the electroconductive material is carbon.

22. The self-locking switch of claim 13, wherein at least one engagement point between the button sub-assembly and the housing sub-assembly must be physically broken to open the self-locking switch.

23. The self-locking switch of claim 14, wherein the button divider extends between the buttons and an upper surface of the button divider portion is one of coincident with the upper surface of the buttons and projecting above the upper surface of the buttons when the button sub-assembly and housing sub-assembly are assembled together.

24. The self-locking switch of claim 23, wherein the upper surface of the button further comprises one of a raised portion and a depressed portion that is positioned near the first end of the button and substantially above the tab extending from a lower surface of the button.

* * * * *